US008869347B2

(12) United States Patent
Tebbens

(10) Patent No.: US 8,869,347 B2
(45) Date of Patent: Oct. 28, 2014

(54) EXTENDED PNEUMATIC CLEANING DEVICE

(71) Applicant: Tebbens Steel LLC, Center Moriches, NY (US)

(72) Inventor: Thomas Tebbens, Center Moriches, NY (US)

(73) Assignee: Tebbens Steel LLC, Center Moriches, NY (US)

( * ) Notice: Subject to any disclaimer, the term of this patent is extended or adjusted under 35 U.S.C. 154(b) by 0 days.

(21) Appl. No.: 13/730,310

(22) Filed: Dec. 28, 2012

(65) Prior Publication Data

US 2014/0182638 A1 Jul. 3, 2014

(51) Int. Cl.

| | |
|---|---|
| ***A47L 5/14*** | (2006.01) |
| ***A47L 11/04*** | (2006.01) |
| ***A47L 11/22*** | (2006.01) |
| ***B08B 5/02*** | (2006.01) |
| ***E01H 1/08*** | (2006.01) |
| *B08B 3/04* | (2006.01) |

(52) U.S. Cl.

CPC ..... *B08B 3/04* (2013.01); *E01H 1/0809* (2013.01); *A47L 5/14* (2013.01); *B08B 5/02* (2013.01); *A47L 11/22* (2013.01); *A47L 11/04* (2013.01)

USPC ..... 15/405; 15/362; 134/198

(58) Field of Classification Search

USPC ..... 134/198

See application file for complete search history.

(56) References Cited

U.S. PATENT DOCUMENTS

| | | | | |
|---|---|---|---|---|
| 2006/0222438 | A1* | 10/2006 | Alexander et al. | 401/48 |
| 2006/0254008 | A1* | 11/2006 | Hahn et al. | 15/50.3 |
| 2008/0189901 | A1* | 8/2008 | Jansen | 15/320 |
| 2009/0083934 | A1* | 4/2009 | Vanderlinden | 15/383 |
| 2009/0265876 | A1* | 10/2009 | Gardner et al. | 15/322 |

* cited by examiner

*Primary Examiner* — Joseph L Perrin
*Assistant Examiner* — Levon J Shahinian
(74) *Attorney, Agent, or Firm* — Fish & Richardson P.C.

(57) ABSTRACT

The present invention is a device which has an extended tube structure attached at one end to a manifold with wheels and slits to allow substance to enter or exit and attached at the other end to a source of air, vacuum, or liquid substance. The device is designed to allow ease and efficiency in storing and shipping.

10 Claims, 5 Drawing Sheets

EXTENDED PNEUMATIC CLEANING DEVICE

FIELD OF THE INVENTION

The present invention is directed to devices and methods for cleaning abrasive prone surfaces. More specifically, the present invention is directed to a device and method for cleaning a hearth, furnace, burner box or crematorium comprising a device having detachable first and second portions, a manifold air brush or sweep and rollers for rolling the manifold air brush or sweep across a surface.

BACKGROUND OF THE INVENTION

The floors and walls of enclosed chambers used for high temperatures such as hearths, kilns, burners, boilers, fireboxes, and crematoriums are often comprised of refractory material as they have direct exposure to heat and flame. Refractory material refers to material capable of enduring high temperatures and includes concrete, firebricks, mortars, castables and ceramic fibers. Hearths, kilns, burners, boilers, fireboxes, crematoriums, and citrus dryers or incinerators are such chambers in which substances are heated or burned resulting in ash, slag, or debris which require collection. The proper removal of these substances is critical for a multitude of reasons and is dependent on the purpose and use of the chambers. For example, proper removal of the ashes following a cremation has both legal and ethical concerns at hand. In the case of crematoriums, best practice and regulation requires that the cremains following each separate cremation be removed and recovered nearly 100% in the hope that the cremains of one cadaver not be mixed with the cremains of a successive cadaver.

Damage to and erosion of the heath can be attributed to a number of reasons including chemical reactivity and physical wear. Refractory linings are subject to regular wear from the scraping or brushing of metal brushes or other tools on the furnace walls or by scraping and bumping during loading. In theory, refractory wear should be uniform, but in practice this does not occur as most often, the refractory surface is composed of modules of refractory material. The most intense wear occurs at the slag/metal interface, where sidewalls join the floor, and at thin spots caused by poor lining installation. Visible hot spots on the exterior metal of any cremator, kiln or furnace are an indication of a refractory issue. Breech of the refractory linings can damage the machinery of the equipment requiring costly repairs or even replacement.

In some cases, the correct method of removing what results from the use of a heating chamber such as an incinerator, furnace or even a crematorium is vital to allow proper functioning and to avoid damage of the equipment. In animal cremators and incinerators, calcium buildup can occur on the surface of the chamber's hearth floor. This accumulation can be cleared from the floor surface occasionally, however if calcium build up remains unchecked, the severe buildup of the mineral can result in unevening of the crematorium floor level, causing grease to leak out of the chamber. In the instance of incinerators, the deposition of slag can be detrimental to the equipment. Slag results when low grade or organic waste materials are used in a combustion process. The term is also used to refer to the byproduct of steelmaking Handling slag deposits is an important factor in controlling the design and operation of high volume processing municipal incinerators. Slag not only adheres to but often also penetrates through and reacts chemically with the refractory material. Over time, its accumulation alters the normal heat flow and congests gas passages resulting in the cracking of refractory modules on the chamber surface and in the interior of the chamber wall. Similarly, citrus peel dryers process waste membrane and peels of pre-processed citrus fruit for the production of citrus pulp pellets to be used as agricultural animal feed. The process results in sharp debris which cuts into the refractory surface of the dryer. Further, acid from the peels erode the chamber surface as well. Lastly, joints, cracks and depressions within high heat chambers which are constructed with modules of refractory material become a place of collection for the debris, by product and cremains, in the case of crematoriums.

Additionally, the resulting dust and ash can, in some instances, affect the efficiency of the equipment. Furnaces are such an example of heat chambers whose neglected maintenance and cleaning can affect the efficiency of the system. Furnaces are a major source of heat production in many parts of the world. The system works by drawing in cold air which is passed through a filter and subsequently heated, sent through a flue and into the duct network of the building. The heavy presence of dirt in the system results in a less efficient furnace as more fuel is required to be burned to produce the same amount of heat. Further, dust, mold, and other allergen contaminants accumulate in the furnace and travel with the heated air into the building where it is breathed in by its occupants.

Proper upkeep of these high heat chambers can require removal of nearly all debris and by products left in the system floor and on its walls. Removing loose soot and debris from the fireside portion of a boiler often involves scrubbing with a wire brush and power vacuuming, whereas water is used to flush the waterside portion of a boiler. Following a cremation, in another example, the cremains are most commonly crudely removed by a blunt ended shovel or hoe, a steel tipped rake or an ordinary broom. Regular vacuums are often used to clean through furnaces. In the case of industrial plants in the chemical and building materials industries, protocols require that the release of particulate into the environment be reduced. Hence, the industry commonly uses wet particulate dust scrubbers to trap particulates and pull them from the gas stream by injecting a liquid, often water, into the waste gas stream and collecting the liquid droplets which impact and entrain the solid matter from the stream and into the sump.

There are various ways refractory materials are placed in incinerators and similar chambers to construct them. In some instances the refractory material can be poured and hardened to a consistency of concrete. Other systems use insulating firebricks for the ceilings whereas older systems utilize ceramic fiber module ceilings. Each module of ceramic fiber contains hardware used to secure the module to the ceiling. Metal studs can then used to secure the module and weld its associated hardware to a metal sheet on the ceiling. Some cremators have a hearth floor consisting of castable tiles which is replaced by pouring a smooth castable floor which is easier to sweep out the cremains. The chamber side walls always consist of firebricks. Refractory insulating materials are also installed behind the cremation chamber side wall to keep an excessive amount of heat from radiating to the exterior of the cremator.

The afterburner chamber walls are often located on the back section of the cremation chamber side wall of certain models. They are defined by an opening, the gas pass window, through which the gases from the main cremation chamber pass and where an afterburner incinerates the pollutants to produce clean air emissions out of the stack. This additional incineration also adds to the buildup of debris which is required to be removed. As described above, the refractory components of such a high heat chamber are most often of a modular nature and require piecewise construction and repair, and hence have joints between the bricks or tiles. The presence of joints together with the wearable refractory material makes the interior chamber susceptible to damage if not emptied properly or with the appropriate equipment.

Individual modules can also be replaced as they wear out however, over time with routine use and wear, the entire ceramic module ceiling or firebrick flooring requires replacement. Retorts in crematories are out of operation about five days per year due to maintenance or repairs. The average cost to re-brick a system in today's market can be $20,000 or more. It is expected that 8000 hours of operation can be performed prior to complete re-bricking if proper wear and tear is exerted on the retort. Exhaust gases from the cremation process can range from 500 to 1000 degrees F. Temperatures can reach 2000 degrees in the instances of large case load and malfunction. To protect against a fire, a refractory lining of sufficient thickness and insulating capabilities is used. The refractory life of the lined stack also requires replacement over time.

An alternative to the commonly used methods and devices for clearing and cleaning such chambers would be the extended sweep. The extended sweep provides a versatile design which allows a vacuum, power washer, or air blower to reach narrow and deep spaces to remove debris with gentle but effective force with minimal damage to the refractory material of the chamber. The thin long neck of the device allows for easy control and access to lengthy chambers or tunnels. The manifold at the front end of the device can be customized to fit the surfaces to be cleared. The air vents on the manifold allow for air flow inward or outward. Multiple streams of air flow will allow for removal of debris from the joints between the refractory material modules and seams between the side wall and the hearth floor or ceiling. The unique design of the extended sweep allows the device to be taken apart into portions which can be easily stored and shipped. It also is designed to not allow virtually any debris or ash to collect in portions of the device. The wheels sit loosely in between the pins on the manifold. The diameter of the wheel's open center is larger than the diameter of the manifold column giving the wheels to move against or away from the manifold independently of each other hence allowing fluid movement over uneven terrain. The extended sweep device effectively extends to difficult to reach areas and clears the surface desired in less time and in a less labor intensive manner.

SUMMARY OF THE INVENTION

The present invention is directed to a device used for clearing a surface comprising a first portion including an extended tube, a second portion including a second extended tube attachable to the first portion having an extended tube, a manifold attachable to the extended tube of the first portion, wherein the manifold comprises ports arranged for the delivery of pressurized fluid or vacuum to a surface beneath the manifold. The manifold further comprising one or more wheels, balls or other roller bearings. The area within the extended tubes and the manifold is continuous and hollow. Such a construction provides an air blower, a vacuum cleaner, or a power washer depending on to what source the device is connected.

In an example embodiment a device for cleaning refractory surfaces such as the inner surfaces of a crematorium comprises: a first extended pipe comprising a proximal end having a connection to a source of pressurized fluid and a distal end having a first coupling; a second extended pipe comprising a proximal end having a first coupling attachable to the distal end of the first extended pipe and a distal end having a second coupling; a manifold comprising, a second coupling attachable the second coupling of the second extended pipe, one or more delivery ports for the delivery of a pressurized fluid, and on or more wheels such that the delivery port is elevated above a surface in contact with the wheels; wherein the first extended pipe, the second extended pipe and he manifold when attached provide a flow path from the connection to the one or more delivery ports.

In another example embodiment of the present invention a device for cleaning refractory surfaces comprises; a first extended pipe comprising a proximal end having a connection to a source of pressurized fluid and a distal end having a first coupling; a second extended pipe comprising a proximal end having a first coupling attachable to the distal end of the first extended pipe and a distal end having a second coupling; and a manifold comprising, a second coupling attachable the second coupling of the second extended pipe; one or more delivery ports for the delivery of a pressurized fluid; and on or more wheels such that the delivery port is elevated above a surface in contact with the wheels, wherein the first extended pipe, the second extended pipe and he manifold when attached provide a flow path from the connection to the one or more delivery ports.

One or more embodiments of the present invention may include one or more of the following features: the wheels are connected to the manifold such as to prevent the collection of particulate matter on the device; the wheels include a gap between the inner surface of the wheel and the outer surface of the manifold to prevent the collection of particulate matter on the device; the wheels include a gap between the side surfaces of the wheels and support pins extending from the outer surface of the manifold to prevent the collection of particulate matter on the device; the first connection between the first and second extended pipes provides longitudinal support to the assembled device by means of a first member extending from the proximal end of the second extend pipe; the first connection provides a unidirectional flow path through the first and second extended pipes; the second connection is a fixed connection; the second connection is a moveable connection that provides a flow path through the first and second extended pipes, the manifold and through the one or more ports; the device comprises stainless steel, copper, bronze, aluminum, composite material, or PVC; the manifold does not include one or more wheels and the one or more delivery ports are arranged to lift the manifold off of the surface when pressurized fluid is applied to the device; the pressurized fluid comprises air, an inert gas, a vacuum or a pressurized liquid; the refractory material to be cleaned is in a crematorium.

In an example embodiment of the present invention an apparatus is provided for moving objects on a surface in a certain direction with the intent to clear said surface of the said object by moving the apparatus along the surface. The said movement of the object can occur as a result of air forced outwardly. The said movement of the object can occur as a result of a vacuum forced inwardly.

A further embodiment comprises a transporter tube, an extender tube, a manifold, two wheels, and a set of pins which hold in place each wheel. The transporter comprises a pipe with a point of attachment of the said transporter pipe to the said manifold, an open-ended lip, a lip wall, and a fastener comprised of threads. The transporter tube can be constructed such that:

The said fastener of the transporter tube is located at a point between the open-ended lip and the point of attachment of the said transporter pipe to the said manifold;

The pipe between the open-end and the fastener is of the same or smaller diameter than the tube of the transporter tube between the fastener and the point of attachment of the said transporter tube to the said manifold;

The said fastener consists of treads which allow the transporter pipe to be attached to the extended tube at the point of the open-ended fastener; and The open-ended lip has around it a lip-wall whose width in that region makes the diameter of the pipe between the open end and the fastener the same diameter as the tube between the fastener and the point of attachment to the manifold.

In an additional embodiment the extended tube is comprised of an end with a handle, a connection nozzle, an open-ended fastener with a tread catcher and a lip.

In still a further embodiment the extended tube can be constructed such that:

Said open-ended fastener is located at one end of the extender tube;

Said open-ended fastener and the nozzle sit on opposite ends of the extender tube; and Said lip catcher is located within the tube at a point between the open ended-fastener and the nozzle The device can be connected to a water (or liquid chemical) supply to spray water or chemical

DETAILED DESCRIPTION

Various implementations and embodiments of the present invention provide an alternative to commonly used methods and devices for clearing and cleaning chambers used for high temperatures. In one embodiment an extended sweep consistent with an implementation of the present invention provides a versatile design which allows a vacuum, power washer, or air blower to reach narrow and deep spaces to remove debris with gentle but effective pneumatic or hydraulic force and imparting minimal damage to the refractory material of the chamber.

In an example embodiment, an extended sweep comprises and elongated first portion, attachable to an elongated second portion, wherein the first and second portions when connected provide a longitudinal delivery chamber for high pressure air, vacuum or fluid. The first portion is connectable to a pressurized air source, a vacuum source or a pressurized fluid source. The second portion is connected to a manifold adapted for uniform distribution of the pressurized air, vacuum or pressurized fluid over a surface. The manifold comprises one or more distribution ports and one or more wheels, balls, roller bearings so that the manifold rolls easily over the surface of the refractory material in the chamber.

In an example embodiment the thin long neck or delivery tube of the device allows for easy control and access to lengthy chambers or tunnels. The manifold at the front end of the device can be customized to fit the surfaces to be cleared. Air vents or ports on the manifold allow for air or fluid flow inward or outward through the vents or ports. Multiple streams of air or fluid flow allow for displacement and ultimate removal of debris from the surface of and joints between the refractory material modules and seams between the side wall and the hearth floor or ceiling. In example embodiments the modular portions of the extended sweep allows the device to be taken apart into portions which can be easily stored and shipped. In still further embodiments the device prevents debris or ash from collecting in portions of the device, such as in the wheels of the device, or where two parts of the device are connected or meet. For example, in some embodiments, the wheels sit loosely in between the pins on the manifold. The diameter of the wheel's open center is larger than the diameter of the manifold column allowing the wheels to move against or away from the manifold independently of each other hence allowing fluid movement over uneven terrain. The extended sweep device effectively extends to difficult to reach areas and clears the surface desired in less time and in a less abrasive manner.

In an example embodiment the extended sweep is comprised of multiple portions which can be assembled for use with a pressurized air source, a vacuum source, or a pressurized water source.

Figure 1:
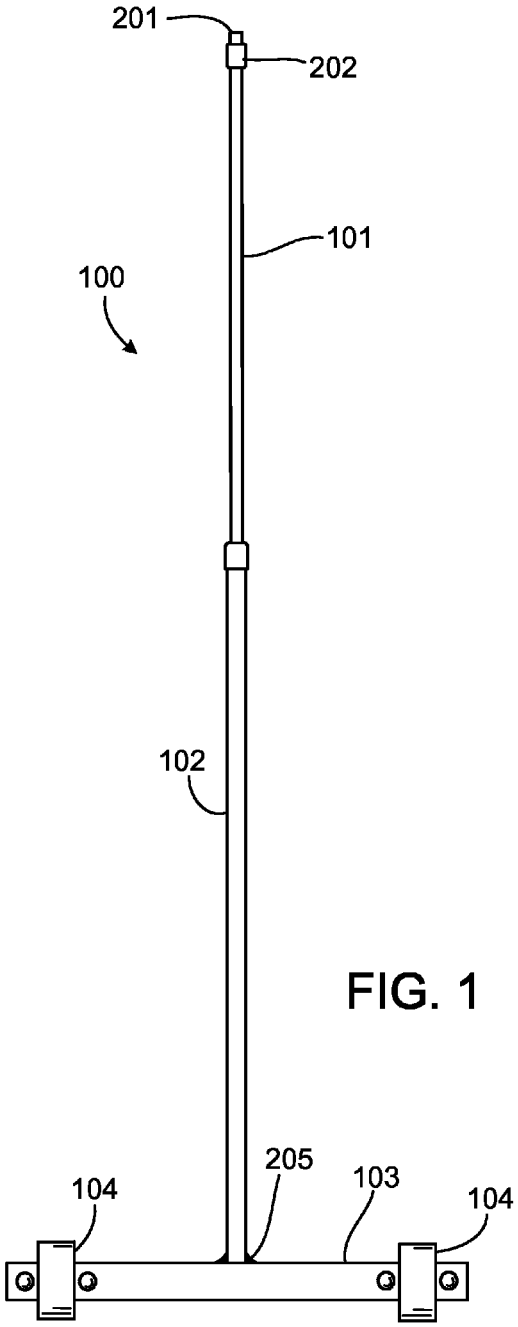
FIG. 1 illustrates a top view of an assembled embodiment of the present invention.
Figure 2:
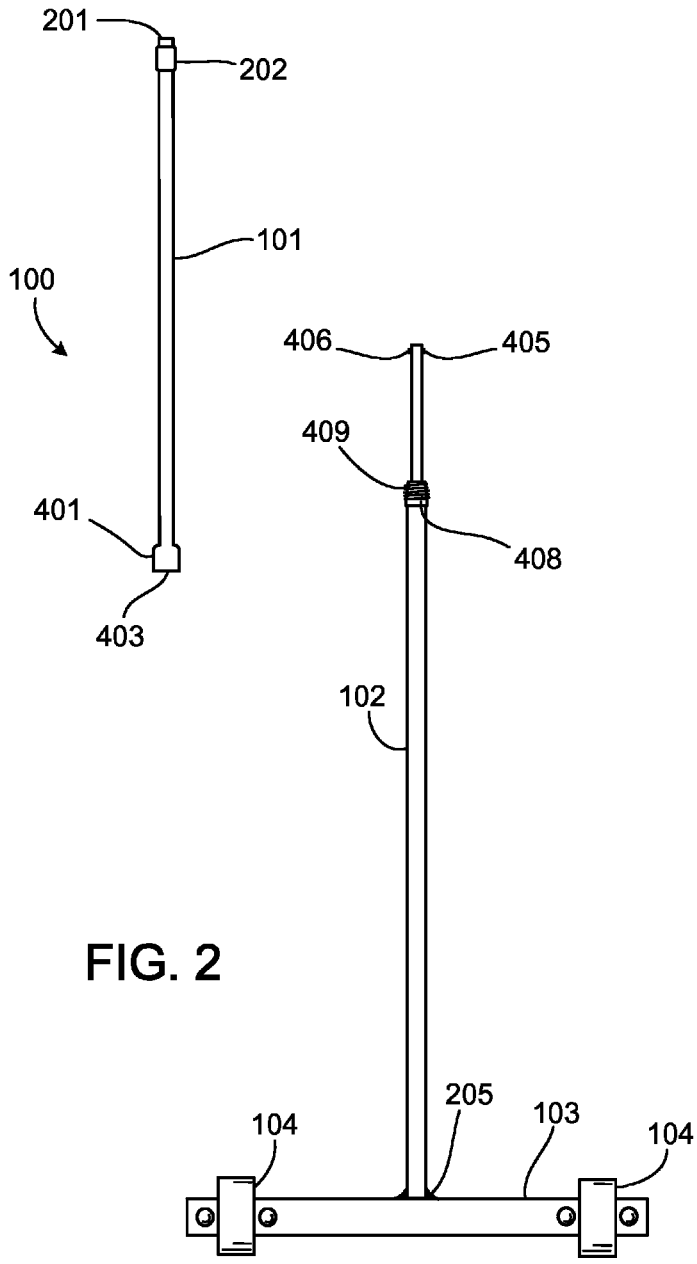
FIG. 2 illustrates a top view of a disassembled embodiment of the present invention.
Figure 3:
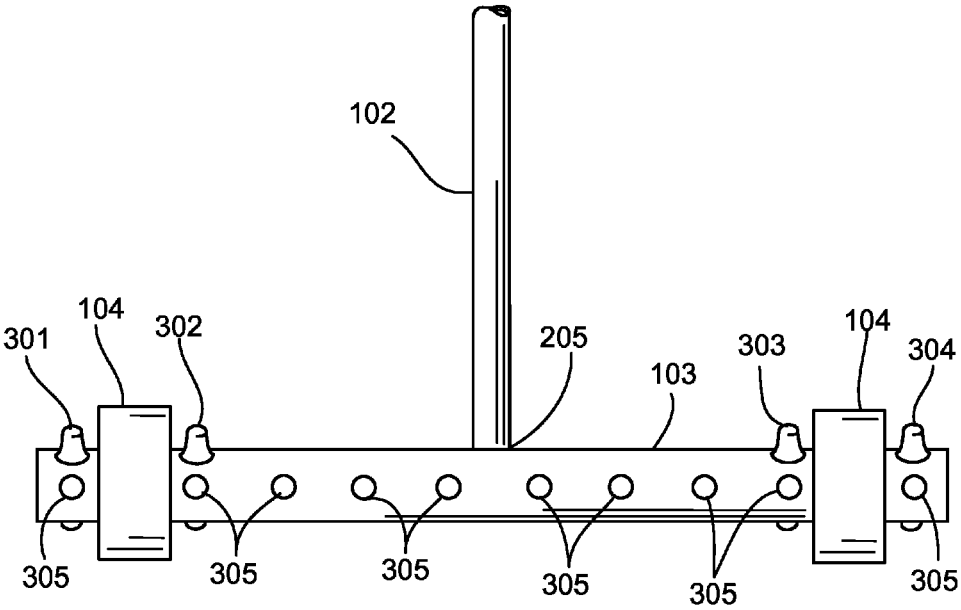
FIG. 3 illustrates a bottom view of the manifold of an embodiment of the present invention.
Figure 4:
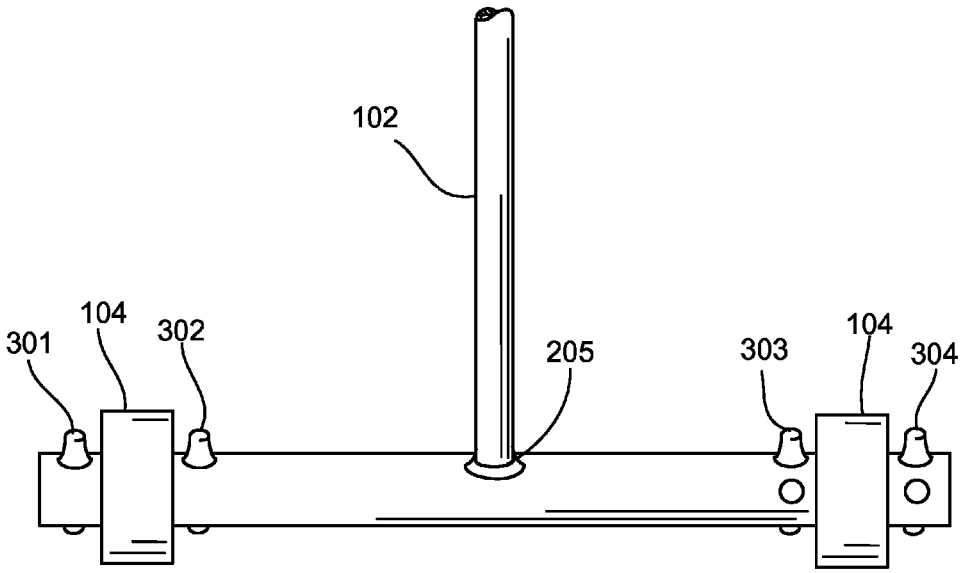
FIG. 4 illustrates a top view of the manifold of an embodiment of the present invention.
Figure 5:
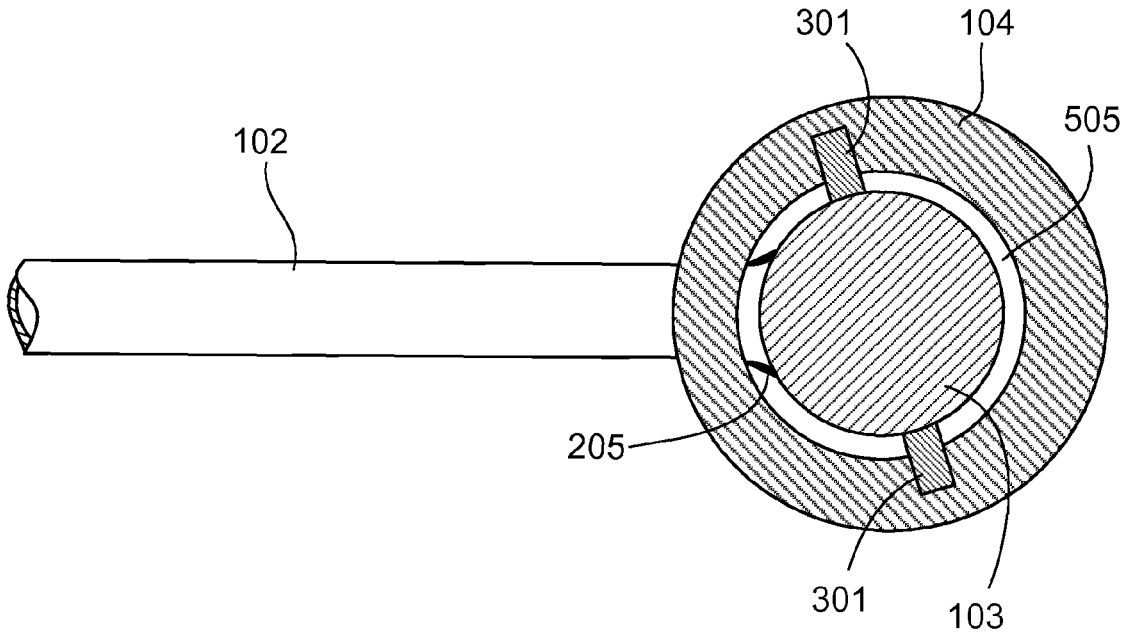
FIG. 5 illustrates a side view of the manifold of an embodiment of the present invention.

Referring to FIG. 1, the illustrated example embodiment of the extend sweep comprises a first portion 101 and a second portion 102. The first portion comprises an extended tube and is attached to a second portion 102, also an extended tube. First portion 101 is a hollow tube whose overall diameter is consistent but consists of an internal diameter which varies along its length. At the proximal end of first portion 101 is a nozzle 201 to which a hose, tube or extension is placed and is in communication with a pressurized air, vacuum or water source. Nozzle 201 is surrounded by rubber region 202 to allow secure fitting of the tube or hose to the proximal end of portion 101. Other securing means are contemplated including nipples, quick connects, threaded fittings, and the like. The distal end of first portion 101 consists of an open ended fastener, 401 and a tread catcher, 403, which sits inside fastener 401.

Portion 402 is provided on the interior of second portion 102. It is comprised of a narrow wall of a certain width which creates an interior opening with a diameter smaller than the diameter of first portion 101. The opening created by the wall of portion 402 would be of a diameter which would allow the entry and comfortable fit of portion 405 which is a certain diameter but would not allow the entry of portion 406 which is a different diameter. Both 405 and portion 406 are on the proximal end of second portion 102.

In an alternate embodiment portion 201, which sits at the proximal end of portion 101, can consist of various interchangeable portions having alternate nozzle tips at position 201. In certain embodiments the nozzle has a long narrow tip. In other embodiments the nozzle has a wide blunt tip. In one embodiment the nozzle is comprised of a rubber material. In another embodiment, the nozzle is comprised of a metal.

In another alternate embodiment proximal end of portion 101 can include a handle which aids in the grasping and maneuvering of the extended sweep device.

In a further example embodiment, second portion 102 is the transporter tube. The proximal end of portion 102 can be fastened into the distal end of portion 101. Portion 102 terminates at the distal end at attachment point 205. Portion 102 is a hollow tube with differing diameters of the exterior wall along the length of the tube. The proximal end of portion 102 is comprised of an open-ended lip, portion 105. Portion 406 is a narrow-width wall set proximally back from portion 405. Fastener 408 sits at a location between the proximal open end of second portion 102 and attachment point 205 at the distal end of portion 102. The exterior of fastener 408 includes threads 409. The region of second portion 102 between the proximal tip and fastener 408 is of a narrower diameter exteriorly and interiorly in comparison to the region of second portion 102 from the point of fastener 408 and attachment point 205. Fastener 408 is of the same diameter as the later region of the tube, i.e. the region extending between Fastener 408 and attachment point 205. In one embodiment the hollow pipe comprised of first portion 101 and second portion 102102 is between approximately 4 and 30 feet in length (e.g., 4, 5, 6, 7, 8, 9, 10, 11, 12, 13, 14, 15, 16, 17, 18, 19, 20, feet greater than 20 feet, lesser than 30 feet) and has a diameter of approximately between 0.1 and 2.5 inches or more (e.g., 0.1, 0.2, 0.25, 0.3, 0.33, 0.4, 0.5, 0.6, 0.66, 0.7, 0.75, 0.8, 0.9, 1.0 inches, greater than 1.0 inches, greater than 2.0 inches, less than or equal to 2.5 inches) and has a portion 103 approximately 12 inches in length with closed ends.

The distance between portion 402 and the distal end of first portion 101 is the same distance between the proximal open end of first portion 102 and portion 408. The distance is not required to be a set distance but these distances as specified on first portion 101 and on second portion 102 must be the same in each individual instance.

In an alternate embodiment of the invention the distal end of portion 102 consists of the point of attachment 205 at which junction 205 is adjunct to the manifold 103. In certain embodiments, second portion 102 can have multiple attachments 205 connecting portion second portion 102 to multiple manifolds, 103. In some embodiments, second portion 102 can have multiple attachments 205 connecting second portion 102 to a manifold 103 whose shape at least partially surrounds second portion 102.

Manifold 103 consists of the manifold region of the extended sweep. Manifold 103 is connected to second portion 102 via attachment 205. In some embodiments, manifold 103 comprises a hollow tube and each end of manifold 103 is sealed closed. The hollow region of manifold 103 connects seamlessly to the hollow region of the distal region of second portion 102. Delivery ports 305 comprise a series of openings and are positioned on the posterior side of portion Manifold 103. In one embodiment, 1 to 12 (e.g., 1, 2, 3, 4, 5, 6, 7, 8, 9, 10, 11, or 12) ports or vents having a diameter of between 0.1 and 1.0 inches (e.g., 0.1, 0.2, 0.3, 0.4, 0.5, 0.6, 0.7, 0.8, 0.9, 1.0, inches, between 0.0 and 0.1 inches, between 0.1 and 0.2 inches, between 0.2 and 0.3 inches, between 0.3 and 0.4 inches, between 0.4 and 0.5 inches, between 0.5 and 0.6 inches, between 0.6 and 0.7 inches, between 0.7 and 0.8 inches, between 0.8 and 0.9 inches or between 0.9 and 1.0 inches) diameters are spaced along manifold 103. In another instance, ports 305 are indented such that flow of the desired substance would be directed in one path. In another embodiment, the ports consist of long narrow slits along manifold 103.

Along the exterior wall of manifold 103 sit a first series of pins 301, 302, 303, and 304 and a second series 306, 307, 308, 309 of pins, or first set of pins 310 and second set of pins 311. Wheels 104 and 105 can have a center diameter larger than the diameter of manifold 103. The pins comprising pin sets 310 and 311 are arranged such that the width of wheels 104 or 105 is surrounded by at least one pin on either side. In one embodiment two sets of pins can be present around each wheel 104 or 105. In one embodiment the wheels are 2 inches in diameter. In one embodiment, wheels 104 and 105 are constructed to allow portion manifold 103 to stand between 0.1 and 1.0 inches (e.g., 0.1, 0.2, 0.3, 0.4, 0.5, 0.6, 0.7, 0.8, 0.9, 1.0, inches, between 0.0 and 0.1 inches, between 0.1 and 0.2 inches, between 0.2 and 0.3 inches, between 0.3 and 0.4 inches, between 0.4 and 0.5 inches, between 0.5 and 0.6 inches, between 0.6 and 0.7 inches, between 0.7 and 0.8 inches, between 0.8 and 0.9 inches or between 0.9 and 1.0 inches) above the surface to be cleaned.

In an alternate embodiment manifold 103 can be a columnar shape. In another embodiment, manifold 103 can be a flat elongated shape such as a square or a rectangle in which there are sealed openings to allow wheels 104 and 105, and additional wheels to support the structure of manifold 103. In another embodiment, manifold 103 can be a tube in the shape of a circle or an oval.

In a further embodiment manifold 103 does not include any wheels, rollers, balls or other such bearings, but instead the delivery ports are arranged to lift the manifold off of the surface to be cleaned when the system is energized.

In some embodiments, the extended sweeper can be used to blow air with a particular amount of force through the system and out of port 305 which sit on manifold 103. In such instance, the device would be connected to, for example, a pressurized air tank at nozzle 201. In another embodiment, the extended sweeper can be used as a vacuum to suction small size debris through ports 305 and into second portion 102 and then first portion 101. In such instance, the device can be connected to a vacuum source at nozzle 201. In yet another embodiment, the extended sweeper can be used to push water through the device. In such instance, the device would be connected to a water tank at portion 201.

In order to store and ship the device, the embodiments of the present invention can be disassembled and reassembled. To assemble the extended sweep, first portion 101 should be held steadily or placed on a flat surface. One should proceed by inserting the proximal end of second portion 102 into the distal end of first portion 101. Second portion 102 should be inserted into first potion 101 until stops 406 sits up against stop 402.

The threads 409 which sit atop 408 are subsequently fastened into portion 403 which sits inside 401 by rotating either first portion 101 or second portion 102 in a manner such that the threads of 409 engage portion 403.

Upon assembly of the extended sweep device, a tube or pipe should be connected to nipple 201 and secured around 202. The tube or pipe should be connected to the desired output. In one embodiment, the tubing is connected to a source of high pressure air in the event the desired function of the device is an air blower. In one embodiment, the tubing is connected to a source of high pressure water in the event the desired function of the device is a power washer. In one embodiment, the tubing is connected to a source of a vacuum in the event the desired function of the device is suction.

Upon use of the device, the ports 305 located on manifold 103 should be faced towards the desired surface to be cleared or cleaned.

In some embodiments pressurized air of between 10 and 200 psi can be used. In one embodiment, pressurized air of approximately 90 psi can be used.

All the portions of the extended sweep unit can be constructed a metal alloy such as stainless steel. In other embodiments, it can be constructed of plain steel, galvanized steel, brass, bronze, aluminum, or titanium. In some embodiments, the device can be constructed of plastic, PVC, fiber reinforced materials, and/or composites.

The invention claimed is:

1. A crematorium cleaning device, comprising;

a. a first extended pipe comprising a proximal end having a connection to a source of pressurized air and a distal end having a first coupling;

b. a second extended pipe comprising a proximal end having a first coupling attachable to the distal end of the first extended pipe and a distal end having a second coupling;

c. a manifold having an outer surface with an outer diameter, and further comprising;

i. a second coupling attachable to the second coupling of the second extended pipe; and ii. one or more delivery ports for the delivery of a pressurized air;

d. a first and second wheel, each wheel comprising;

i. an inner surface having an inner diameter greater than the outer diameter of the manifold, ii. an outer surface having an outer diameter, and wherein each of the first and second wheels encircle at least a portion of the manifold such that the manifold is an axel for each wheel; and e. wherein the first extended pipe, the second extended pipe and the manifold when attached via the first coupling of the first extended pipe and the second extended pipe and the second coupling of the second extended pipe and the manifold provide a flow path from the connection to the one or more delivery ports.

2. The device of claim 1 wherein the inner surfaces of the first and second wheels are in partial contact with at least a portion of the outer surface of the manifold.

3. The device of claim 1 wherein the second extended pipe further comprises an interior support pipe extending proximally from the first coupling of the second extended pipe and into the first extended pipe.

4. The device of claim 1 wherein the first extended pipe provides a unidirectional flow path.

5. The device of claim 1 wherein the second coupling of the second extended pipe and the second coupling of the manifold comprise a fixed connection, wherein the manifold is not detachable from the second extended pipe.

6. The device of claim 1 wherein the second coupling of the second extended pipe is detachable from the second coupling of the manifold.

7. The device of claim 1 wherein the device comprises stainless steel.

8. The device of claim 1 wherein the first and second wheels include a width to provide a rollable bearing for moving the device across a crematorium surface, supporting the weight of the device without scratching or scoring the crematorium surface.

9. The device of claim 1 wherein the manifold further comprises two pairs of pins extending outwardly from the outer surface of the manifold, each pin in the pair of pins being a different distance from the center of the manifold than the other pin in the pin pair, and wherein the first wheel is positioned between a pin pair and the second wheel is positioned between the other pin pair.

10. A crematorium cleaning device, comprising:

a rigid extended pipe comprising;

a connection to a pressurized air supply, and a coupling for attachment to a manifold;

the manifold having an outer surface and an outer diameter, and further comprising;

a coupling for attachment to the extended pipe, at least one pressurized air delivery port, and two or more pins projecting outwardly from the outer surface of the manifold, wherein each of the pins are at a different distance from the center of the manifold, the distance between the pins forming a pin width, at least one wheel comprising;

an inner surface with an inner diameter greater than the outer diameter of the manifold, an outer surface with an outer diameter;

a wheel width being less than the pin width; and wherein the at least one wheel is positioned between the two or more pins and encircles at least a portion of the manifold, such that the manifold is an axle to the at least one wheel.

* * * * *